US011406908B2

(12) United States Patent
Clephan et al.

(10) Patent No.: US 11,406,908 B2
(45) Date of Patent: Aug. 9, 2022

(54) BALLOON HOLDER AND BLANK FOR FORMING A BALLOON HOLDER

(71) Applicant: B-Loony Ltd., Chesham (GB)

(72) Inventors: James Clephan, Chesham (GB); David House, Chesham (GB)

(73) Assignee: B-Loony Ltd., Chesham (GB)

( * ) Notice: Subject to any disclaimer, the term of this patent is extended or adjusted under 35 U.S.C. 154(b) by 260 days.

(21) Appl. No.: 16/505,164

(22) Filed: Jul. 8, 2019

(65) Prior Publication Data

US 2020/0009467 A1 Jan. 9, 2020

Related U.S. Application Data

(63) Continuation of application No. PCT/GB2019/051581, filed on Jun. 6, 2019.

(51) Int. Cl.
*A63H 27/10* (2006.01)

(52) U.S. Cl.
CPC ..... *A63H 27/10* (2013.01); *A63H 2027/1041* (2013.01)

(58) Field of Classification Search
CPC ..... A63H 27/10; A63H 2027/1041
USPC ..... 446/220, 222
See application file for complete search history.

(56) References Cited

U.S. PATENT DOCUMENTS 1,201,045 A * 10/1916 Head ..... A63H 27/10 446/222
1,467,411 A * 9/1923 Witten ..... A63H 27/10 446/222
1,680,318 A * 8/1928 Callahan ..... A63H 27/10 446/222
2,396,906 A * 3/1946 Windson ..... A63H 27/10 446/222
2,931,133 A * 4/1960 Dodson ..... A63H 27/10 446/222
3,094,807 A * 6/1963 Dorman ..... A63H 27/10 446/222
3,783,551 A * 1/1974 Allison ..... A63H 27/10 446/222
3,900,989 A * 8/1975 Weisenthal ..... A63H 27/10 446/222
3,978,555 A * 9/1976 Weisenthal ..... A44B 11/14 24/543
4,380,103 A * 4/1983 McGrath ..... A44B 99/00 24/30.5 P
4,416,038 A * 11/1983 Morrone, III ..... A44B 99/00 24/487

(Continued)

FOREIGN PATENT DOCUMENTS

GB 2272170 A 5/1994
JP S5649179 A 5/1981
JP 2002143571 A 5/2002

*Primary Examiner* — Alexander R Niconovich
(74) *Attorney, Agent, or Firm* — Hunton Andrews Kurth LLP

(57) ABSTRACT

There is provided a balloon holder having an elongate handle and a balloon-receiving portion. The balloon-receiving portion has a first aperture adapted to permit a neck of a balloon to pass through, and at least one slit for receiving and securely engaging a neck of a balloon. The elongate handle and balloon-receiving portion are folded from a single sheet of material, and the elongate handle comprises two plies of the single sheet of material.

29 Claims, 5 Drawing Sheets

(56) References Cited

U.S. PATENT DOCUMENTS 4,589,854 A * 5/1986 Smith ..... A63H 27/10 40/214
4,661,081 A * 4/1987 Basseches ..... A63H 27/10 446/220
4,715,841 A * 12/1987 Nelson ..... A63H 27/10 24/545
4,798,554 A * 1/1989 Nelson ..... A63H 27/10 446/220
4,813,902 A * 3/1989 Messer ..... B42D 15/02 40/124.15
5,021,022 A * 6/1991 Ganz ..... A63H 27/10 446/220
5,301,392 A * 4/1994 Richman ..... A63H 27/10 24/30.5 R
5,411,427 A * 5/1995 Nelson ..... A63H 27/10 24/30.5 P
5,628,091 A * 5/1997 Mueller ..... A63H 27/10 24/129 B
5,799,377 A * 9/1998 Carroll ..... A63H 27/10 24/30.5 R
6,007,403 A * 12/1999 Urspringer ..... A63H 27/10 24/30.5 S
6,050,874 A * 4/2000 Ries ..... A63H 27/10 446/220
6,375,534 B1 * 4/2002 Burns ..... A63H 27/10 40/212
6,527,615 B1 * 3/2003 Boehler ..... A63H 27/10 24/30.5 R
7,249,991 B1 * 7/2007 Watson ..... A63H 27/10 24/30.5 S
7,322,073 B2 * 1/2008 Cuisinier ..... A44B 99/00 24/30.5 S
7,507,137 B1 * 3/2009 Rouse ..... A63H 27/10 428/12
D592,710 S * 5/2009 Cesari ..... D21/453
8,292,335 B1 * 10/2012 Hemingway ..... A63H 27/10 289/17
8,568,190 B2 * 10/2013 Nelson ..... A63H 27/10 446/220
9,011,195 B2 * 4/2015 Sidwell ..... G09F 21/06 446/220
10,279,277 B2 * 5/2019 Nelson ..... A63H 27/10
2003/0148701 A1 * 8/2003 Turjanmaa ..... A63H 27/10 446/220
2004/0198146 A1 * 10/2004 Murray ..... A63H 27/10 446/220
2006/0292960 A1 * 12/2006 Muller ..... A63H 27/10 446/220
2008/0166942 A1 * 7/2008 Hou ..... A63H 27/10 446/86
2014/0338155 A1 * 11/2014 DeNyse, Jr. ..... A63H 27/10 24/20 R
2019/0358555 A1 * 11/2019 Zhou ..... A63H 27/10
2020/0230511 A1 * 7/2020 Aguillar Paulon .... A63H 27/10
2020/0320913 A1 * 10/2020 Dewitt ..... G09F 21/06
2021/0039004 A1 * 2/2021 Lim ..... A63H 27/10

* cited by examiner

BALLOON HOLDER AND BLANK FOR FORMING A BALLOON HOLDER

CROSS-REFERENCE TO RELATED APPLICATIONS

This is a continuation application of International Patent Application No. PCT/GB2019/051581 filed Jun. 6, 2019, claiming priority to United Kingdom Patent Application No. 1811170.8 filed Jul. 6, 2018 and United Kingdom Patent Application No. 1821180.5 filed Dec. 24, 2018, the entire contents of which all are incorporated herein by reference.

The present invention relates to a balloon holder, for holding a balloon, typically in the hand of a child for their entertainment or enjoyment.

A known balloon holder is made of one continuous plastic moulding and usually comprise a stem portion which serves as a handle, and a balloon receiving portion at the end of the stem portion which is typically in the shape of an inverted cone. The balloon will usually be inflated and then positioned in a holding feature cut out of the inverted cone, and this may be apertures or slits sized and shaped to receive and hold the neck of the balloon. A typical example of a known balloon holder can be seen in GB 2 272 170 A.

Conventional balloon holders are mostly made from polypropylene or another plastics material. Despite the current push to reduce plastics usage in many applications, balloon holders have not advanced into greener materials because they are cheap and easy to manufacture in their current form from plastics materials. Furthermore, there are typically two types of holders available—holders which can hold rubber/latex/plastic balloons and holders which can hold mylar/foil balloons.

It is an object to provide a balloon holder which overcomes one or more of the above problems.

According to a first aspect of the present invention, there is provided a balloon holder having an elongate handle and a balloon-receiving portion, wherein the balloon-receiving portion has a first aperture adapted to permit a neck of a balloon to pass through, and at least one slit for receiving and securely engaging a neck of a balloon, and the elongate handle and balloon-receiving portion are folded from a single sheet of material.

The sheet material may be biodegradable, such that the balloon holder is environmentally friendly.

Additionally, the elongate handle may comprise two plies of the single sheet of material. Preferably, the first ply is the first elongate handle portion and the second ply is the second elongate handle portion. This provides improved strength and rigidity over a single-ply handle.

Preferably, the first aperture may be located on a central longitudinal axis of the elongate handle. This provides a balloon holder where the balloon will sit directly above the handle, and so above the hand holding the handle. This provides the advantage of providing a stable holding arrangement whereby the position of the balloon can be more easily controlled, particularly in windy conditions.

Additionally, the first and second elongate handle portions may be provided with creases, i.e. linear embossed or debossed portions. The creases are preferably registered such that when the handle portions are brought together the creases intersect. There may preferably be a plurality of diagonal creases, the ends of the creases being spaced from the longitudinal edge of the planar handle portion. The creases, and particularly the alignment of the creases such that they intersect in an 'X' pattern, provides rigidity to the handle. The spacing from the longitudinal edge of the planar handle portion allows the creases to provide rigidity without creating a fold line.

Preferably, the planar handle portions may be equal in length. This provides a rigid structure throughout the entire length of the handle.

Preferably, the creases of each planar handle portion may be registered with the creases of the other planar handle portion, such that the creases intersect at an angle of between 30° and 90°, providing strength and rigidity to the arrangement.

Additionally the balloon holder may also comprise a second aperture in the balloon-receiving portion adapted to permit a neck of a balloon to pass through. This allows a balloon to be passed from the outside, into the holder and back out to the outside where it can be tied off and/or secured easily.

Additionally the first aperture may be larger than the second aperture. The first aperture receives the neck of the balloon, and having a larger aperture here allows for the balloon body to be pulled into the aperture such that it will grip the body of the balloon and keep it more stable than if a smaller aperture were to be used. The second aperture may be smaller, since this does not grip the body of the balloon and instead only the neck passes through this, so a small aperture ensures that the neck is held in place after it has passed through rather than having a large aperture to move around within.

Additionally, it is preferable to position the first aperture centrally on the balloon-receiving portion. This means that the balloon will sit upright and will be stable when the balloon holder is moved, as positioning the first aperture offset from the centre would cause it to not be positioned optimally for stability and visual appearance, which is important for a balloon holder.

Additionally, the balloon holder may have a plurality of pre-formed fold lines, which may be embossed fold lines or debossed fold lines. Embossing and debossing are advantageous methods of creating the fold lines in such products, particularly if the products are made from cardboard as the cardboard may simply be cut to shape to form a blank with the required features already mentioned, and the fold lines created easily, either at the same time as cutting, or afterwards. The blank can then be easily folded by an end user to adopt the final shape.

Additionally, one of the plurality of fold lines may be positioned between the first aperture and the second aperture. This positioning means that when a fold is made at this fold line, the second aperture will move out of the plane of the first aperture, and it will be easier for the user to pass the neck through both apertures. Additionally, a second fold line of the plurality of fold lines may be parallel to the first fold line. This ensures the symmetry of the balloon holder.

Additionally, the balloon-receiving portion may comprise a plurality of slits for receiving and securely engaging a neck of a balloon. Simple slits are a very user friendly way of securing the balloon neck. They are also very easy to manufacture into the balloon holder, by punching and/or cutting. The neck of the balloon may be wrapped around the balloon-receiving portion and clamped in one or more slits, so that the balloon is held in a sealed manner, without the need for a knot to seal the balloon. Moreover by wrapping a balloon neck around the balloon-receiving portion, the folded parts which form the elongate handle are held together.

Additionally, the elongate handle may comprise two planar handle portions in contact with each other. This is advantageous as it has allowed the elongate handle to be made strong and thick enough to be gripped and provide support for the balloon on the end of the balloon holder when in use, whilst also allowing it to be manufactured from one sheet then folded together to provide additional strength. Wrapping the balloon neck around the balloon-receiving portion may serve to hold the two planar handle portions in contact with each other.

Additionally, the balloon-receiving portion may comprise a substantially planar mounting portion which is perpendicular to the plane of the elongate handle. This provides the advantage that the balloon will be mounted on this mounting portion which, because it is perpendicular to the handle, will keep the balloon upright when in use. Additionally, the first aperture may be in the substantially planar mounting portion, allowing the first aperture to grip the balloon in this upright position.

Additionally, the balloon-receiving portion may further comprises at least two wall portions connecting the substantially planar mounting portion to the elongate handle by fold lines. This provides the advantage of having a strengthening portion around the mounting portion where the balloon will sit. In strong winds or if the child is running for example, the balloon may experience a relatively strong force, and the mounting portion where the balloon will sit will also experience that force. Providing side wall portions to connect the mounting portion to the elongate handle provides stability and strength to the structure and also provides a surface where other securing features can be positioned, possibility a plurality of slits or a second aperture. If the slits are provided in the wall portions, then wrapping the balloon neck around the wall portions and passing it through the slits serves to hold the wall portions and the two planar handle portions together. Preferably, the second aperture is provided in one or both of the side wall portions.

Additionally, the arrangement provided allows that the balloon holder may be made from cardboard. This has clear environmental advantages over plastics.

Additionally, the first aperture may have a dimension in a direction parallel to the fold lines which is greater than the dimension in a direction perpendicular to the fold lines. The planar mounting portion may be substantially rectangular in shape and may have a dimension in a direction parallel to the fold lines which is greater than the dimension in a direction perpendicular to the fold lines. These chosen relative dimensions, particularly together, provide stability to the balloon holder when it is in use holding a balloon, and serve to ensure the balloon does not blow over by allowing it to be held in the holder in a firm and stable position.

Additionally, the balloon holder may further comprise a flap in the balloon receiving portion, preferably in one of the side wall portions, which is adapted to permit a neck of a balloon to pass therethrough. The flap may be adapted to securely engage a neck of a balloon. This provides a balloon holder which can be used with foil/mylar balloons, as these balloons are held better by a suitably arranged flap than by the second aperture and the slits alone. Unlike rubber/latex balloons, foil balloons cannot stretch to be pulled tight. The second aperture may be configured for allowing a rubber balloon to pass therethrough. This allows for the possibility of having an aperture for passing a rubber balloon through, and/or a flap for engaging a foil balloon. Thus, the balloon holder can be adapted to accommodate either type of balloon, or even both types of balloons. This provides a significant advantage, as retailers/outlets only need to stock one type of balloon holder for either type of balloon.

According to a second aspect of the present invention, there is provided a blank for forming a balloon holder, the blank comprising a balloon-receiving portion having a first aperture adapted to permit a neck of a balloon to pass through, a plurality of fold lines, at least one slit for receiving and securely engaging a neck of a balloon, a proximal end and a distal end, a first elongate handle portion connected to the proximal end of the balloon-receiving portion at a first handle fold line, a second elongate handle portion connected to the distal end of the balloon-receiving portion at a second handle fold line; such that the first elongate handle portion and the second elongate handle portion can be brought together to form an elongate handle such that the balloon receiving portion will be at one end of the elongate handle; wherein the blank is a single sheet of material.

The first and second elongate handle portions may be equal in length, which provides a rigid handle when they are folded together to form a handle.

Additionally, the first elongate handle and the second elongate handle portion may each comprise at least one crease, i.e. linear embossed or debossed portions. Creases in the elongate handle portions increases the rigidity of each elongate handle portion. Preferably, each elongate handle portion may comprise a plurality of parallel diagonal creases, the ends of each crease being spaced from the longitudinal edge of the planar handle portion. The creases, and particularly the alignment of the creases such that they intersect in an 'X' pattern, provides rigidity to the handle. The spacing from the longitudinal edge of the planar handle portion allows the creases to provide rigidity without creating a fold line.

Additionally, the creases may intersect at an angle of between 30° and 90° when the blank is folded to form a two-ply elongate handle. This provides a strong and rigid handle.

The balloon-receiving portion may further comprise one or more second apertures adapted to permit a neck of a balloon to pass through. The first aperture may be larger than the second aperture. The first aperture is positioned centrally on the balloon-receiving portion.

The blank may have a flap in the balloon receiving portion which may be adapted to permit a neck of a balloon to pass through, and furthermore the flap may be adapted to securely engage the neck of the balloon which is passed through. This provides a blank which can form a balloon holder for a foil balloon.

The balloon receiving portion may comprise a central mounting portion, a proximal wall portion extending from the first handle fold line to a first wall fold line at the central mounting portion, and a distal wall portion extending from the second handle fold line to a second wall fold line at the central mounting portion. In use the elongate handle portions may be folded down from the central mounting portion on the wall fold lines, so that the wall portions extend at an angle from the central mounting portion to meet at the handle fold lines at the upper ends of the elongate handle portions.

The first aperture may be located in the central mounting portion, and the second aperture may be located in one or both of the proximal and distal wall portions, thus allowing an arrangement whereby (when folded) a rubber balloon neck can be easily passed through the first aperture and then the second aperture.

Alternatively or additionally, the flap may be in one or both of the proximal and distal wall portions, thus allowing an arrangement (when folded) whereby a foil balloon neck can be easily passed through the first aperture and the flap and then the balloon neck can be securely held by the flap.

Conveniently, the first aperture may be in the central mounting portion, the second aperture in one of the proximal and distal wall portions, and the flap in the other of the proximal and distal wall portions. This provides a balloon holder which is capable of holding either rubber or foil balloons. A rubber balloon would be located in the holder by passing the neck of the rubber balloon through the first and second apertures. A foil balloon would be located in the holder by passing the neck of the foil balloon through the first aperture and then through the flap, with the flap also being used to securely hold the neck of the foil balloon when the flap is closed onto the neck of the foil balloon.

Preferably the plurality of fold lines are parallel. The plurality of fold lines may be embossed or debossed fold lines.

Preferably the balloon receiving portion comprises a plurality of slits for receiving and securely engaging a neck of a balloon. These may be in the wall portions. There may be a lit on each lateral side of each wall portion.

The blank may be made from cardboard or other suitable foldable material.

Additionally, the first aperture may have a dimension in a direction parallel to the fold lines which is greater than the dimension in a direction perpendicular to the fold lines. The central mounting portion may be substantially rectangular in shape, wherein the planar mounting portion may have a dimension in a direction parallel to the fold lines which is greater than the dimension in a direction perpendicular to the fold lines. These chosen relative dimensions, particularly together, serve such that once the blank has been assembled into a balloon holder, they will ensure the balloon does not blow over by allowing it to be held in the holder in a firm and stable position.

Embodiments of the invention will now be described, by way of example only, and with reference to the following drawings, in which.

Figure 1:
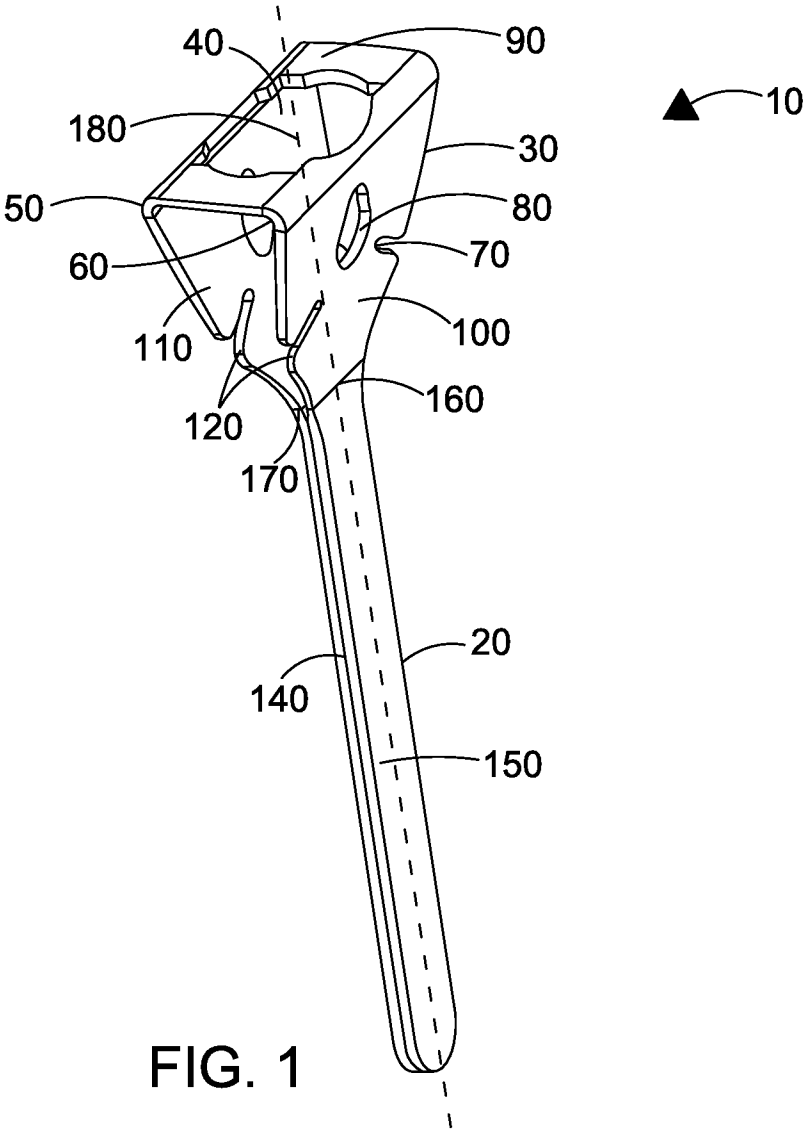
FIG. 1 shows a balloon holder in accordance with the first aspect of the present invention.

Referring to FIG. 1, a first embodiment of a balloon holder 10 is shown, in accordance with the present invention. The balloon holder 10 is for holding an inflated balloon. The balloon holder 10 has two main components, an elongate handle 20 and a balloon-receiving portion 30. The elongate handle 20 is sized and shaped such that it can be held by a person, typically a child. The balloon receiving portion 30 is the portion of the balloon holder 10 which can hold and secure the balloon such that it will not fall from the balloon holder 10 when a child is walking with the balloon holder 10 or waving the balloon holder 10 in the air. The balloon-holder 10 has a first aperture 40 which is sized and arranged such that it permits a neck of a balloon to be passed through.

The balloon holder 10 also has a plurality of fold lines 50, 60 which allow the balloon-receiving portion 30 to be formed into shape from a single sheet of material. The balloon receiving portion 30 also comprises at least one slit 70 for receiving and securely engaging the flange at the end of the neck of a balloon. A slit 70 is used to secure the neck as it is easy to pass the neck of a balloon into the slit 70 and the flange at the neck will be held against the slit 70. The slit 70 is sized and shaped such that a tie is not required in the end of the balloon, and the balloon will instead be sealed by inserting into the slit 70. The balloon holder 10 may further comprise a second aperture 80 which is adapted to allow a balloon to pass through. The first and second apertures 40, 80, mean that a balloon neck can be passed into the first aperture 40 and out of the second aperture 80, where it can then be secured by the at least one slit 70. Preferably, the first aperture 40 is larger than the second aperture 80. A larger first aperture 40 is preferable as the balloon will be pulled down into the balloon holder 10 as it is tied off in the slit 70, and a larger aperture 40 will allow the balloon holder 10 to more firmly secure the balloon. The second aperture 80 does not hold the balloon in the same way as the first aperture 40, and in this first embodiment the second aperture is instead simply for passing the neck through so that it can be tied off, and therefore a smaller second aperture 80 is preferable.

It is also preferable to position the first aperture centrally in the balloon receiving portion 30, which is also preferably centrally in a mounting portion 90, which is a planar portion of the balloon-receiving portion 30, and is perpendicular to the elongate handle 20. This mounting portion 90 ensures that the balloon stays upright in the balloon holder 10 when in use. The fold lines 50, 60 allow the balloon-receiving portion to be folded into shape to form the mounting portion 90, and two side walls 100, 110. The fold lines 50, 60 may be made in any suitable way such that a fold may be performed by hand by a person when the balloon holder is used. The fold lines 50, 60 may be created by embossing or debossing the material, performing a fold during manufacture, scoring the material, or any other suitable method. The fold lines 50, 60 may be positioned between the first and second apertures 40, 80, such that when a fold is performed, the second aperture 80 is moved out of the plane of the first aperture 40, which makes it easier for the user to pass the balloon neck through. The fold lines 50, 60 are preferably parallel, such that a symmetrical fold will be performed on both sides of the balloon holder 10 when it is folded to allow it to take shape from a flat sheet of material to a balloon holder 10.

The balloon holder 10 may further comprises a plurality of slits 70, 120 such that the balloon neck can be wrapped around the balloon-receiving portion 30 and secured into multiple slits. Preferably the slits 70, 120 are positioned on the two side walls 100, 110. This would create a very secure holding mechanism for holding the neck of the balloon tightly in place. The slits 70, 120 may be any suitable shape and size to receive the neck of the balloon. In the embodiment shown the slits 70, 120 are at approximately 45 degrees to the horizontal and so point towards the second aperture 80. This is preferable as it will help to engage the balloon neck and hold it within the slits 70, 120, however it is not essential, and the slits may be at a different angle.

The elongate handle 20 may be comprised of two handle portions 140, 150. Each of the handle portions 140, 150 are part of the same sheet of material as the balloon-receiving portion 30. The first handle portion 140 is connected to a proximal end 170 of the balloon-receiving portion 30, and the second handle portion 150 is connected to a distal end 160 of the balloon-receiving portion 30. The connections at the proximal and distal ends 160, 170 each comprise a fold line. The fold lines used at both the mounting portion 90 of the balloon-receiving portion 30, and at the connections at the proximal and distal ends 160, 170, allows the balloon handle 10 to be folded from a blank, which means the whole product can be made from a single material, which is preferably cardboard, but could be another material that can be provided in sheet form and which a blank can be cut from it.

It is preferable that the first aperture 40 has a dimension in a direction parallel to the fold lines 50, 60 which is greater than the dimension in a direction perpendicular to the fold lines 50, 60, for example a substantially oval shape. It is also preferable that the mounting portion 90 is substantially rectangular in shape and that mounting portion 90 has a dimension in a direction parallel to the fold lines 50, 60 which is greater than the dimension in a direction perpendicular to the fold lines 50, 60. These features provide more stability to a balloon when it is mounted in the balloon holder 10 than other shapes might provide. It is however possible that other shapes would provide the required stability, particularly if the mounting portion 90 is another suitable shape, such as a square. It is envisaged that any suitable shape of mounting portion 90 and first aperture 40 could be used.

The elongate handle 20 shown in FIG. 1 comprises two plies of the single sheet of material. These two plies are the first elongate handle portion 140 and the second elongate handle portion 150. It is preferable that the first aperture 40 is located on a central longitudinal axis 180 of the elongate handle 20, as shown in FIG. 1.

Figure 2:
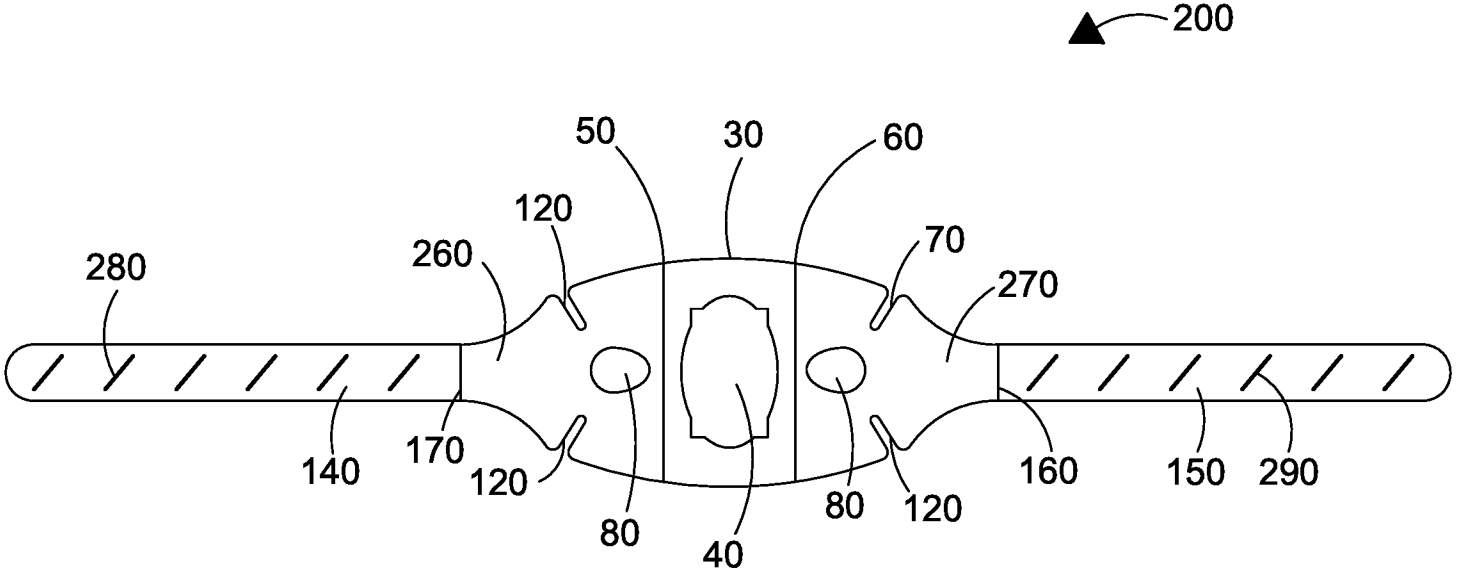
FIG. 2 shows a blank for forming a balloon holder in accordance with the second aspect of the present invention.

A blank 200 is shown in FIG. 2 in accordance with the present invention, used to make the balloon holder 10 of FIG. 1. The blank 200 is a flat sheet of material, and comprises a balloon-receiving portion 30 having a first aperture 40 adapted to permit a neck of a balloon to pass through. The blank 200 also has a plurality of fold lines 50, 60, 160, 170, four slits 70, 120 for receiving and securely engaging a neck of a balloon, a proximal end 260 and a distal end 270. The blank 200 also has a first elongate handle portion 140 connected to the proximal end 260 of the balloon-receiving portion 30 at a first handle fold line 170; a second elongate handle portion 150 connected to the distal end 270 of the balloon-receiving portion 30 at a second handle fold line 170. This means that the first elongate handle portion 140 and the second elongate handle portion 150 can be brought together to form an elongate handle 20 such that the balloon receiving portion 30 will be at one end of the elongate handle 20. The elongate handle 20 is a two-ply handle, where the first ply is the first elongate handle portion 140 and the second ply is the second elongate handle portion 150. This provides increased strength and rigidity over a single-ply handle. The blank 200 is a single sheet of material. The blank 200 in this example has two second apertures 80, such that when the blank is folded into a balloon holder 10, the first and second apertures 40, 80 will both be able to receive a balloon neck and allow it to pass through. The arrangement allows for a balloon neck to be passed from the outside of the balloon holder, through the first aperture 40, and back out to the outside through one of the second apertures 80, and then wrapped around the balloon-receiving portion 30. The entire blank 200 may be made from cardboard, with simple fold lines, slits and apertures being cut into the blank to provide the necessary folding arrangement to provide the 3D object, and with the necessary features to engage and hold a balloon in place.

The first elongate handle portion 140 may optionally have a first set of creases 280, and the second elongate handle portion 150 may optionally have a second set of creases 290. The first and second sets of creases 280, 290 are scores that increase the rigidity of the first and second elongate handle portions 140, 150. They may be formed by embossing, and preferably do not extend to the edges of the handle portion 140. The strengthening effect of the creases 280, 290 on each of the first elongate handle portion 140 and second elongate handle portion 150 is increased when both elongate handle portions 140, 150 are brought together to form a two-ply handle portion. Preferably, when the creases 280, 290 are present on the elongate handle portions 140, 150, the creases 280, 290 are registered such that each individual crease comes together with a corresponding crease on the other elongate handle portion when the blank 200 is folded into a balloon holder. Preferably, the creases are arranged diagonally in the same direction (as shown in FIG. 2) when the balloon holder is manufactured as a blank 200. This allows each crease to come together with a corresponding crease on the other elongate handle portion to intersect and form an 'X' pattern of intersecting straight lines. The creases intersect at an angle of between 30° and 90°, providing strength and rigidity to the arrangement, since each handle portion is stiffened by the creases in a different direction.

FIG. 2 shows six creases in each elongate handle portion 140, 150. It will be appreciated that any number of creases may be used, and the number of creases on each handle portion 140, 150 may or may not be equal to the number of creases on the other elongate handle portion 140, 150. Lesser creases on one of the elongate handle portions 140, 150 may, for example, leave a space for branding or other features which may be desired on the elongate handle portion 140, 150. Preferably however, the number of creases will be equal and registered with corresponding creases on the other elongate handle portion to provide maximum rigidity when the blank is assembled.

As shown in FIG. 2, the spacing from the longitudinal edge of the handle allows the creases to provide rigidity without creating a fold line.

Figure 3:
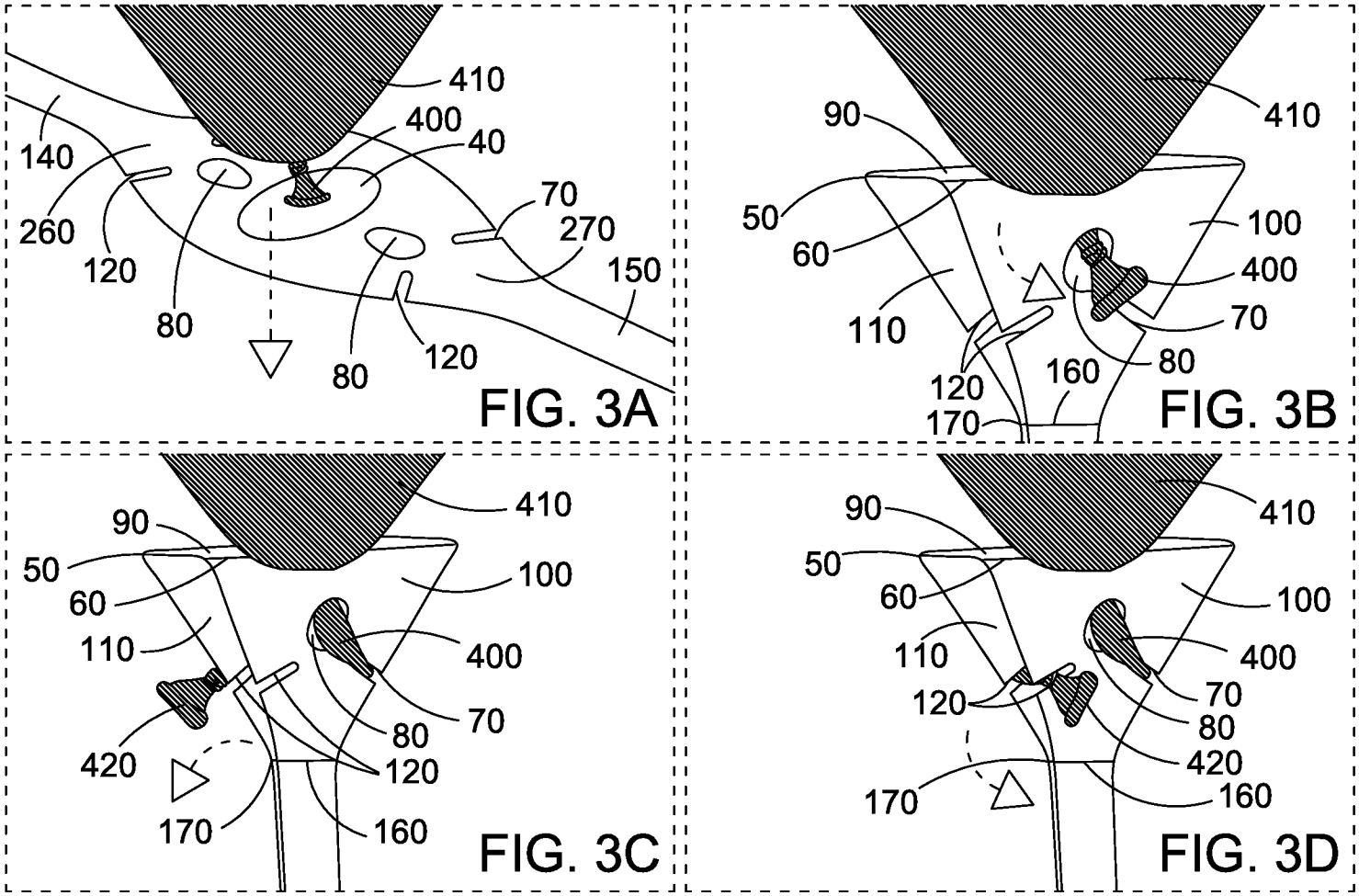
FIG. 3 shows a method of using the blank and balloon holder in accordance with the first and second aspects of the present invention.

The method of using the blank to make a balloon holder 10, and subsequently hold a balloon 410 is shown in FIGS. 3*a* to 3*d*. This method seals and secures into the holder an inflated untied balloon 410. The first step is shown in FIG. 3*a*, where the neck 400 of an inflated but untied balloon 410 is gripped and passed through the first aperture 40, while the balloon holder is still in an unfolded state, in the form of a blank 200. The two handle portions 140, 150 are then folded down to the position shown in FIG. 3*b*, and the neck 400 of the balloon is passed through the second aperture 80. In FIG. 3*c* the neck 400 is wrapped around the balloon receiving portion 30 and engaged with the plurality of slits 70, 120 spaced around the walls 100, 110 of the balloon-receiving portion 30. In the final step shown in FIG. 3*d*, the flange 420 at the end of the neck 400 is secured in the final slit 120. The neck of the balloon may be left untied, because the clamping action of the slits 70, 120 on the neck 400 is enough to seal the balloon so the air does not escape. These four steps not only seal and hold the balloon, but also serve to hold the balloon holder together without the need for fixations or adhesives, since the tension in the neck 400 pulls the wall portions 100, 110 together. Not requiring adhesives makes the holder 10 more environmentally friendly, safer for children and reduces litter associated with the use of adhesives requiring a release paper.

Figure 4:
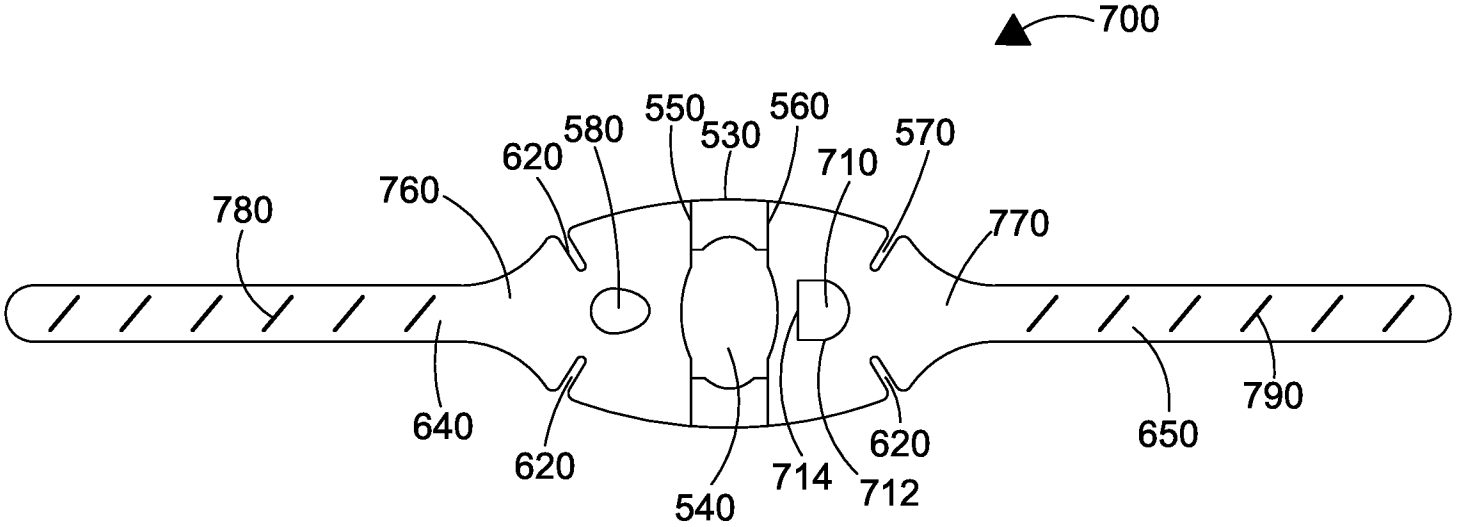
FIG. 4 shows a blank for forming a balloon holder in accordance with the second aspect of the present invention.

A second embodiment of the invention is now described with reference to the blank 700 shown in FIG. 4, where like reference numerals are used to indicate like features with respect to the blank 200 of FIG. 2, with the addition of 500.

The blank 700 is a flat sheet of material for forming a balloon holder in accordance with the first aspect of the invention, with additional features making the resulting balloon holder compatible with rubber and foil balloons. The blank 700 comprises a balloon-receiving portion 530 having a first aperture 540 adapted to permit a neck of a balloon to pass through. The blank 700 also has a plurality of fold lines 550, 560, four slits 570, 620 for receiving and securely engaging a neck of a balloon, a proximal end 760 and a distal end 770.

The blank 700 also has a first elongate handle portion 640 connected to the proximal end 760 of the balloon-receiving portion 530, and a second elongate handle portion 650 connected to the distal end 770 of the balloon-receiving portion 530. This means that the first elongate handle portion 640 and the second elongate handle portion 650 can be brought together to form an elongate handle such that the balloon receiving portion 530 will be at one end of the elongate handle. The elongate handle is a two-ply handle, where the first ply is the first elongate handle portion 640 and the second ply is the second elongate handle portion 650. This provides increased strength and rigidity over a single-ply handle. The blank 700 is a single sheet of material.

The blank 700 in this example has only one second aperture 580, such that when the blank is folded into a balloon holder, the second aperture 580 will be able to receive a balloon neck and allow it to pass through. The arrangement allows for a balloon neck to be passed from the outside of the balloon holder, through the first aperture 540, and back out to the outside through the second aperture 580, and then wrapped around the balloon-receiving portion 530. In this embodiment, the blank 700 further comprises a flap 710. The flap is formed by a curved cut line 712 and a linear fold line 714 which acts as a hinge to permit opening of the flap 710 by pressure on the flap 710. which is configured to allow the balloon neck to pass through the flap 710, and then close on the balloon neck to securely hold the balloon neck in the flap 710. After a portion of the balloon neck is held in the flap 710, the remainder of the balloon neck can be wrapped around the balloon receiving portion 130 and secured into multiple slits 571, 620.

The entire blank 700 may be made from cardboard, with simple fold lines, slits and apertures being cut into the blank to provide the necessary folding arrangement to provide the 3D object, and with the necessary features to engage and hold a balloon in place.

The blank 700 is for forming a balloon holder which is capable of holding both rubber/plastic/latex balloons and also foil/mylar balloons. The second aperture 580 is suitable for receiving therethrough the neck of a rubber/plastic/latex balloon, which is subsequently tied off and secured within one or more of the slits 620, 570. The flap 710 is suitable for receiving therethrough the neck of a foil/mylar balloon, wherein the flap securely engages the balloon and holds it.

Similarly to the embodiment described with reference to FIG. 2, the first elongate handle portion 640 may optionally have a first set of creases 780, and the second elongate handle portion 650 may optionally have a second set of creases 790. The first and second sets of creases 780, 790 are scores that increase the rigidity of the first and second elongate handle portions 640, 650. The strengthening effect of the creases 780, 790 on each of the first elongate handle portion 640 and second elongate handle portion 650 is increased when both elongate handle portions 640, 650 are brought together to form a two-ply handle portion. Alternatively to the embodiment described with reference to FIG. 2, the creases 780, 790 are registered such that each individual crease comes together with a corresponding crease on the other elongate handle portion such that the creases overlap completely and are in the same direction when the balloon holder is assembled. More preferably, the creases on one elongate handle portion, for example the first elongate handle portion 640, may be debossed and the creases on the other elongate handle portion, for example the second elongate handle portion 650, may be embossed. This allows the embossed creases to mate with the debossed creases, providing strength and rigidity to the arrangement, since each elongate handle portion is stiffened by the support of the creases of the other elongate handle portion.

Figure 5:
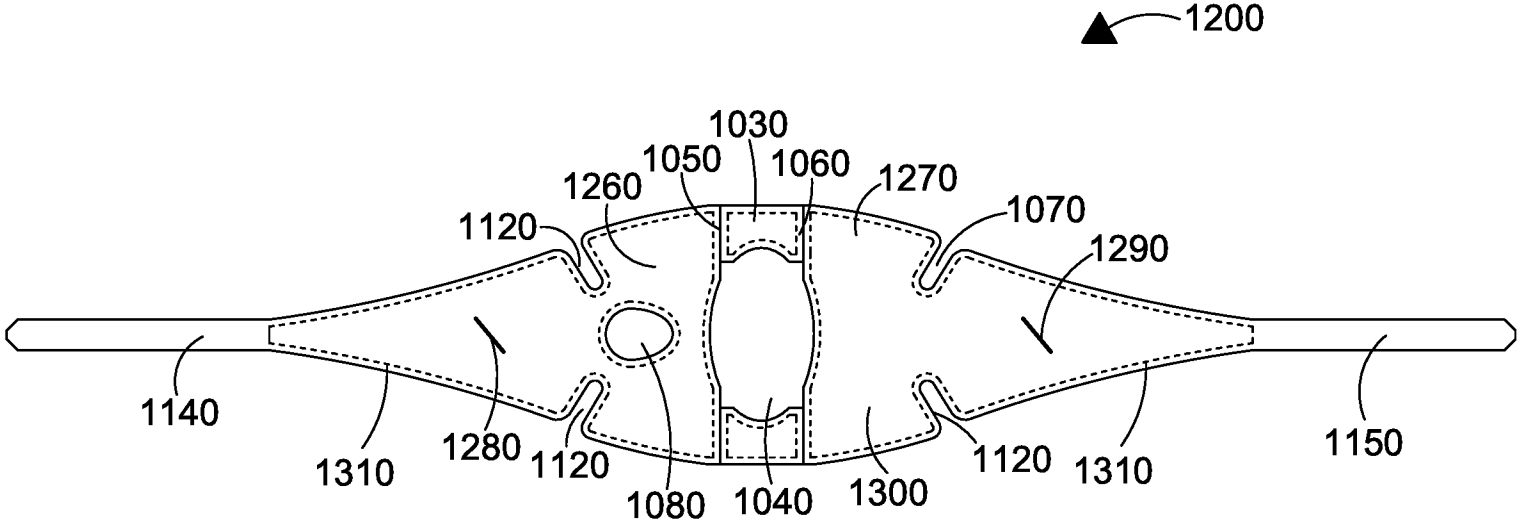
FIG. 5 shows a blank for forming a balloon holder in accordance with the second aspect of the present invention.

Referring now to FIG. 5 which shows a third embodiment of the invention with like reference numerals used to indicate like features with respect to the blank 200 of FIG. 2, with the addition of 1000.

The third embodiment differs from the first and second embodiments in two main ways. Firstly, there is only one second aperture 1080, which leaves a large space 1300 for printed matter. Other small spaces suitable for printed matter are indicated by the dashed line boundaries 1310. This is particularly convenient, as it is advantageous to provide such a space on a balloon holder, as this can be used for advertising, branding, instructions and/or interactive labelling such as providing a QR code to the user, or a barcode which may be scannable by VR headsets, for example. The embodiment described with reference to FIG. 5 further differs from the embodiment described in FIG. 2 in that each elongate handle portion 1140, 1150 is a narrow handle portion, which is sufficiently narrow such that it can be inserted into a balloon holder mounting. Balloon holder mountings already exist which are designed to receive narrow handles of traditional balloon holders. The narrow handle of the presently described embodiment serves to allow the use of the presently described invention with existing balloon holder mountings, which greatly reduces the cost and work involved in changing existing balloon holder mountings to accommodate the new design.

Cardboard has an advantage over plastics in terms of recycling, and the solution presented provides strong balloon holder which can be manufactured economically and replace current plastic holders.

The invention claimed is:

1. A balloon holder having an elongate handle and a balloon-receiving portion, wherein:

the balloon-receiving portion has a first aperture adapted to permit a neck of a balloon to pass through, and at least one slit for receiving and securely engaging a neck of a balloon; the elongate handle and balloon-receiving portion are folded from a single sheet of material; and the elongate handle comprises two plies of the single sheet of material, the balloon-receiving portion comprises a substantially planar mounting portion which is perpendicular to a-plane of the elongate handle, the first aperture is in the substantially planar mounting portion, the balloon-receiving portion further comprises two wall portions connecting the mounting portion to the elongate handle, the wall portions being connected to the mounting portion and to the elongate handle by fold lines.

2. The balloon holder of claim 1, wherein the first aperture is located on a central longitudinal axis of the elongate handle.

3. The balloon holder of claim 1, wherein the balloon-receiving portion also comprises a second aperture adapted to permit a neck of a balloon to pass through.

4. The balloon holder of claim 3, wherein the first aperture is larger than the second aperture.

5. The balloon holder of claim 1, wherein the first aperture is positioned centrally on the balloon-receiving portion.

6. The balloon holder of claim 1, wherein the balloon receiving portion comprises a plurality of slits for receiving and securely engaging a neck of a balloon.

7. The balloon holder of claim 1, wherein the elongate handle comprises two planar handle portions in contact with each other.

8. The balloon holder of claim 7, wherein each planar handle portion comprises at least one crease, and wherein ends of each crease are spaced from a longitudinal edge of the planar handle portion.

9. The balloon holder of claim 1, wherein a second aperture is in one of the wall portions.

10. The balloon holder of claim 1, wherein slits for receiving and securely engaging a neck of a balloon are provided in each of the wall portions.

11. The balloon holder of claim 1, wherein the first aperture has a dimension in a direction parallel to the fold lines which is greater than the dimension in a direction perpendicular to the fold lines.

12. The balloon holder of claim 1, wherein the planar mounting portion is substantially rectangular in shape, wherein the planar mounting portion has a dimension in a direction parallel to the fold lines which is greater than the dimension in a direction perpendicular to the fold lines.

13. The balloon holder of claim 1, further comprising a flap adapted to permit a neck of a balloon to pass through.

14. The balloon holder of claim 1, wherein the balloon holder is made from cardboard.

15. A balloon mounted in a balloon receiving portion of a balloon holder, wherein the balloon holder is a balloon holder according to claim 1, wherein the balloon comprises a neck which extends through a first aperture of the balloon holder and is securely held by a balloon receiving portion of the balloon holder.

16. A blank for forming a balloon holder, the blank comprising:

a balloon-receiving portion having a first aperture adapted to permit a neck of a balloon to pass through, a plurality of fold lines, at least one slit for receiving and securely engaging a neck of a balloon, a proximal end and a distal end;

a first elongate handle portion connected to the proximal end of the balloon-receiving portion at a first handle fold line; and a second elongate handle portion connected to the distal end of the balloon-receiving portion at a second handle fold line;

such that the first elongate handle portion and the second elongate handle portion can be brought together to form a two-ply elongate handle such that the balloon receiving portion will be at one end of the two-ply elongate handle; wherein the blank is a single sheet of material.

17. The blank of claim 16, wherein the first and second elongate handle portions are equal in length.

18. The blank of claim 16, wherein the first elongate handle portion and the second elongate handle portion each comprise at least one crease, and wherein ends of each crease are spaced from a longitudinal edge of the respective first and second elongate handle portions.

19. The blank of claim 16, wherein the balloon-receiving portion further comprises a second aperture adapted to permit a neck of a balloon to pass through.

20. The blank of claim 19, wherein the first aperture is larger than the second aperture.

21. The blank of claim 19, wherein the plurality of fold lines are parallel.

22. The blank of claim 19, wherein the balloon receiving portion comprises a plurality of slits for receiving and securely engaging a neck of a balloon.

23. The blank of claim 19, wherein the blank is made from cardboard.

24. The blank of claim 19, wherein the central mounting portion is substantially rectangular in shape, wherein a central mounting portion has a dimension in a direction parallel to the fold lines which is greater than the dimension in a direction perpendicular to the fold lines.

25. The blank of claim 16, wherein the first aperture is positioned centrally on the balloon-receiving portion.

26. The blank of claim 16, wherein the balloon receiving portion comprises a central mounting portion, a proximal wall portion extending from the first handle fold line to a first wall fold line at the central mounting portion, and a distal wall portion extending from the second handle fold line to a second wall fold line at the central mounting portion.

27. The blank of claim 26, wherein the first aperture is in the central mounting portion, and a second aperture is in one or both of the proximal and distal wall portions.

28. The blank of claim 26, wherein the first aperture is in the central mounting portion, further comprising one or more flaps adapted to permit a neck of a balloon to pass through provided in one or both of the proximal and distal wall portions.

29. The blank of claim 26, wherein the first aperture is in the central mounting portion and a second aperture is in one of the proximal and distal wall portions, further comprising a flap adapted to permit a neck of a balloon to pass through and provided in the other of the proximal and distal wall portions.

* * * * *